United States Patent [19]

Guggemos

[11] 4,450,513

[45] May 22, 1984

[54] LIGHTING FIXTURE FOR OPPOSITE DIRECTION REFLECTION

[75] Inventor: Arthur R. Guggemos, Winsted, Minn.

[73] Assignee: Sterner Lighting Systems Incorporated, Winsted, Minn.

[21] Appl. No.: 342,233

[22] Filed: Jan. 25, 1982

[51] Int. Cl.[3] ..... F21V 7/00

[52] U.S. Cl. ..... 362/299; 362/97; 362/127; 362/298; 362/300; 362/301; 362/346; 362/349; 362/362; 362/375; 362/410

[58] Field of Search ..... 362/97, 127, 298, 299, 362/300, 301, 346, 349, 362, 375, 410

[56] References Cited

U.S. PATENT DOCUMENTS

| | | | |
|---|---|---|---|
| 335,979 | 2/1886 | Viele | 362/346 |
| 1,457,426 | 6/1923 | Cameron | 116/202 |
| 1,471,625 | 10/1923 | Opsahl | 116/202 |
| 1,948,516 | 2/1934 | DeVault | 240/41.3 |
| 2,128,470 | 8/1938 | Phillips | 362/346 |
| 3,701,898 | 10/1972 | McNamara, Jr. | 240/103 R |
| 4,174,533 | 11/1979 | Barthes et al. | 362/297 |
| 4,300,185 | 11/1981 | Wakamatsu | 362/33 |

*Primary Examiner*—Stephen J. Lechert, Jr.
*Attorney, Agent, or Firm*—Kinney & Lange

[57] ABSTRACT

A light fixture having a reflector for directing light beams generally in a first direction, such as an indirect lighting reflector, which has a tab that is partially punched out and bent to reflect a restricted spot of light in an opposite direction. This permits the highlighting or illumination of an area on the back side of the reflector without extra bulbs and without ugly add-on reflectors.

8 Claims, 3 Drawing Figures

LIGHTING FIXTURE FOR OPPOSITE DIRECTION REFLECTION

BACKGROUND OF THE INVENTION

1. Field of the Invention

The present invention relates to lighting fixtures having reflectors, and specifically to a reflector that reflects the major amount of light in one direction but has a small tab that reflects light in a generally opposite direction.

2. Description of the Prior Art

Various devices for light projection and reflection are numerous in the prior art. U.S. Pat. No. 335,979 shows a locomotive headlamp reflector with a series of narrow slots that allow light to pass through the reflector. Each slot has a wing along its border which acts as a shield and extends generally parallel to the light rays. The wings are not used to redirect the light rays to a selected area and in fact, if these wings did redirect the light beams to any substantial extent they would destroy the purpose of the slots, which is to illuminate an area outside the reflector. Supplemental reflectors are placed at the sides of the main reflector to redirect light rays from the headlamp after the rays have passed through the slots. This clearly shows the lack of teaching of the present invention.

Several other patents show main or primary reflectors with secondary or supplemental reflectors for redirecting light. U.S. Pat. Nos. 1,457,426 and 1,471,625 both describe devices having secondary reflectors which direct a small amount of the light from a general illumination source in a different direction from the light reflected from the primary reflector of said source. U.S. Pat. Nos. 2,128,470 and 4,174,533 shows devices with primary and secondary reflectors wherein the secondary reflectors are positioned within the primary reflectors to intensify or redirect the light rays from a general illumination source. Other patents showing light projection or reflection devices are U.S. Pat. Nos. 1,948,516 and 3,701,898.

It is desirable in some instances to direct light from an illumination source in generally opposite directions as indicated by the prior art. Additionally, in some applications appearance and efficiency are of primary concern so that it is not desirable to place a secondary reflector at the side of a primary reflector to direct the light in an opposite direction because to do so would destroy the overall appearance of the device. In the prior art, the common way to provide a small down light spot from an indirect light reflector was to provide a second light bulb on the outside of the main reflector and within the outer lamp housing so that it was hidden from view and would direct light in a second opposite direction. The second bulb required its own socket and socket support wiring.

The light projection fixture of the present invention provides a simple and efficient device to overcome these difficulties. Not only does the present invention direct a small area of light in a generally opposite direction from the main light direction using only one illumination source, but it does so in an aesthetically pleasing fashion. The result is a light projection fixture which is economical, simple of design and manufactured with ease.

SUMMARY OF THE INVENTION

The present invention is a light fixture primarily of the indirect lighting type which has a primary dish shaped or concave reflector defining a cavity. The bulb is within the confines of the reflector and the light is directed primarily in one direction, for example toward the ceiling of a room. The area on the back side of the reflector (outside the reflector but not aligned with the opening) stays dark, except there is a small secondary opening through the wall. A secondary reflector is positioned inside the cavity area, fixed to the wall adjacent the secondary opening and directs light beams from the light source in the cavity out the secondary opening in a second generally opposite direction from the majority of the light.

In the preferred embodiment, the primary reflector and one or more secondary reflectors are formed integrally. The secondary reflector is merely a tab partially cut out from but still attached to the wall of the primary reflector and bent out of the wall a desired amount. The small secondary opening in the wall is the area of the wall cut out to form the tab. The tab must be bent away from the wall so that a portion of the light beams from the illumination source in the cavity of the primary reflector are directed by the tab through the small secondary opening in the wall of the primary reflector.

As shown, a housing for the light fixture surrounds the primary reflector and includes side walls, a generally open top and a bottom wall. The primary reflector is mounted in the housing on the side walls so that light beams are directed by the primary reflector in the generally first direction through the open top of the housing. The bottom wall of the housing has an aperture aligned with the small secondary opening in the wall of the primary reflector for allowing light beams directed by the secondary reflector through the secondary opening in the wall of the primary reflector to pass through the bottom wall of the housing. A fresnel lens may be positioned in the aperture of the bottom wall of the housing to disperse the light beams directed in the second generally opposite direction through the aperture.

The second reflector may be used to provide light to illuminate an artwork or planter, or to provide a beam of light adequate for reading.

DETAILED DESCRIPTION OF THE PREFERRED EMBODIMENTS

Figure 1:
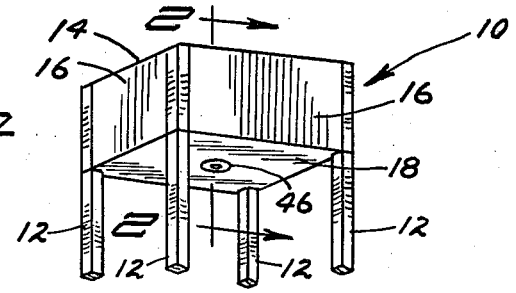
FIG. 1 is a perspective view of a light fixture made according to the present invention.

FIG. 1 shows a light fixture 10 of the present invention mounted on a plurality of support legs 12. The fixture 10 is a floor supported lamp for indirect lighting which directs the majority of the light upwardly toward the ceiling of a room. A housing 14 has side walls 16 and a bottom wall 18. The side walls 16 have inwardly extending lips 19 used to mount a primary reflector 20. The primary reflector has an edge flange 22 formed to be supported on lips 19 and be secured thereto by fasteners 24.

Figure 2:
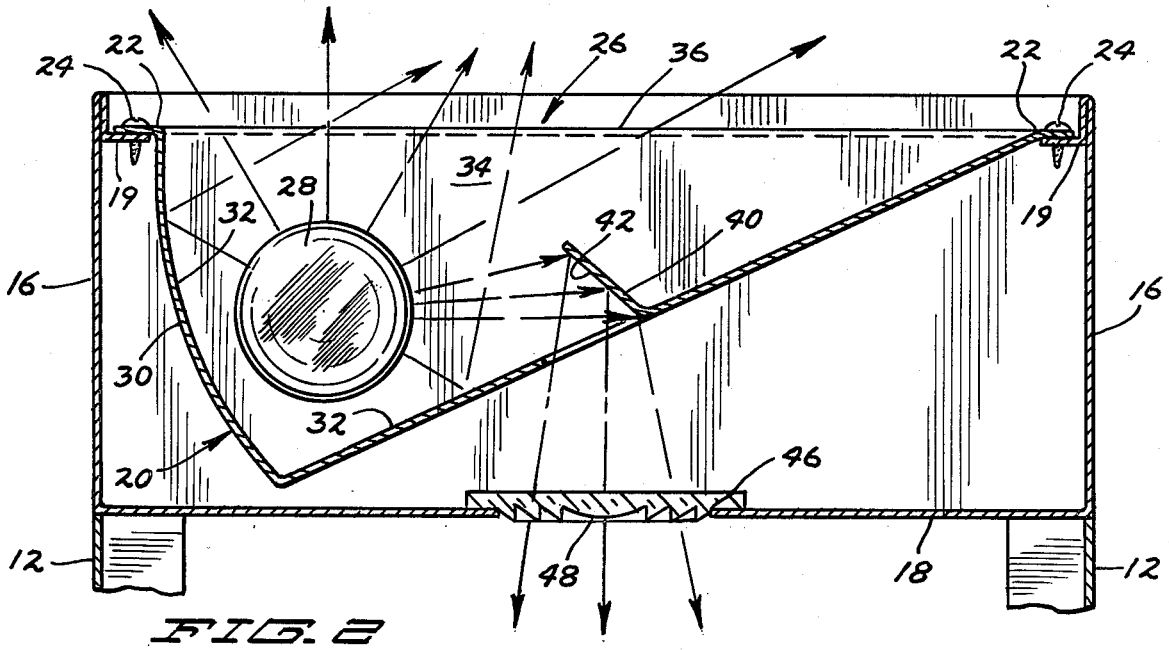
FIG. 2 is a sectional view along section 2—2 of FIG. 1.
Figure 3:
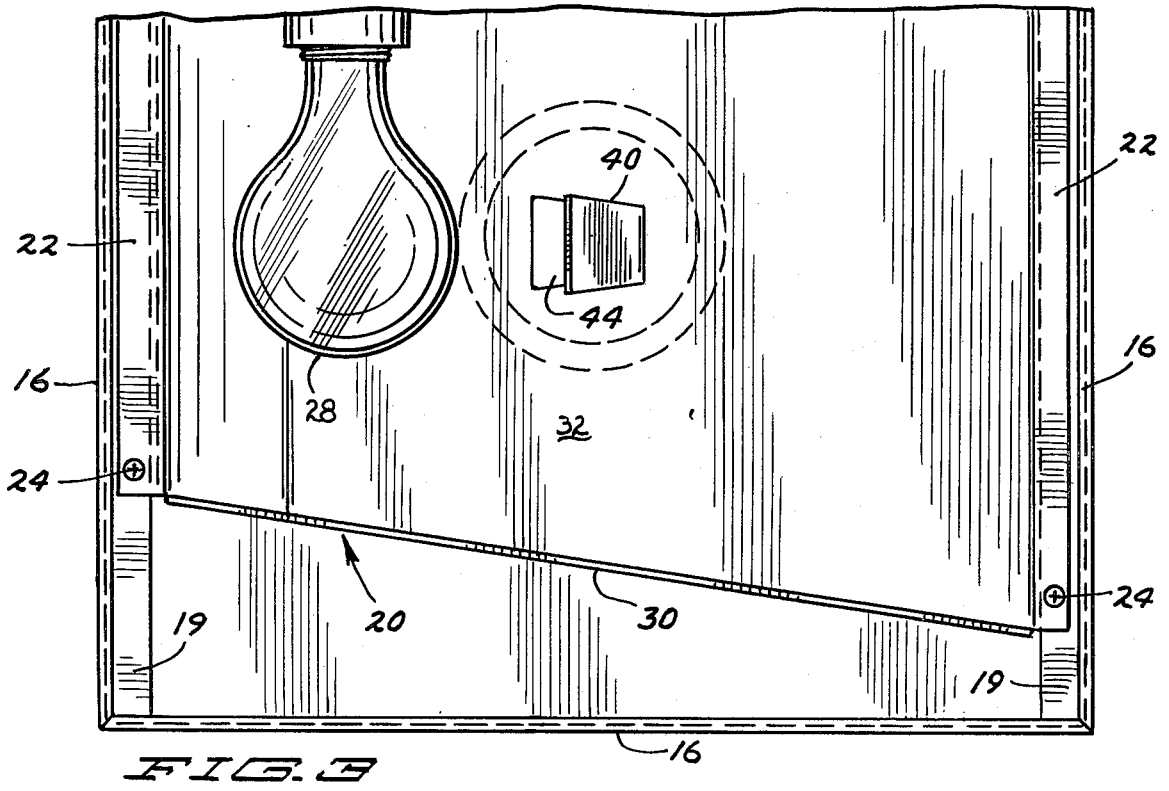
FIG. 3 is a partial top view of the light fixture of FIG. 1.

The housing has a top opening 26 through which light is directed. The primary reflector 20 has a wall 30, one side of which is a reflector surface 32. On its reflector surface side 32, wall 30 is dish shaped or concave and defines a cavity 34 having an opening 36 aligned with opening 26 of the housing 14. Light beams from illumination source 28 are reflected from reflector surface 32 in the generally first direction and out of the opening 36 of the wall 30 of the reflector 20. Light beams from illumination source 28 directed in the generally first direction are shown generally in FIG. 2 with upwardly extending arrows. The view in FIG. 3 is from the top of the housing 14 down through the top opening 26 and opening 30 so that the primary reflector 20 and illumination source 28 are shown. Of course, a light transmittive cover, such as glass or translucent plastic, may be placed over the open top area 26 to protect the fixture 10 from damage and dust.

A secondary reflector 40 having a second reflector surface 42 is positioned within the cavity 34. The wall 30 of the primary reflector 20 has a tab forming the secondary reflector 40 partially punched or slit out and bent up from the wall 30. One edge of the tab remains attached to the wall, and when the tab is bent it leaves a small secondary opening 44. The secondary reflector 40 is thus positioned at one edge of the smaller secondary opening 44 and is bent at an appropriate angle so that light beams from illumination source 28 reflect off of the reflector surface 42 and are directed in a second generally opposite direction through the small secondary opening 44 in the wall 30 of the primary reflector 20. In FIG. 2, the portion of light beams from illumination source 28 reflected through the smaller opening 44 by the secondary reflector 40 are shown with downwardly extending arrows.

The bottom wall 18 of the housing 14 has an aperture 46 so that light beams directed through opening 44 by the reflector surface 42 of secondary reflector 40 may pass through the aperture 46 of the bottom wall 18 of the housing 14. To disperse the light beams passing through aperture 46 in a uniform fashion, a fresnel lens 48, as shown, is secured in the aperture 46 of the bottom wall 18.

If desired, the secondary reflector 40 may be a separate piece attached adjacent a previously formed small secondary opening 44 in wall 30. However, the preferred embodiment construction of merely slitting a tab and bending it into position simplifies construction.

In operation, the light fixture 10 of the present invention provides the majority of the light in a generally first direction and a significantly smaller amount of light in a second generally opposite direction. Light from illumination source 28 is directed in the generally first direction by reflector 20 through opening 36 of cavity 34 and open area 26 of housing 14. A portion of the light from illumination source 28, however, is directed in a second generally opposite direction by secondary reflector 40 located completely within the confines of the cavity 34. The light directed in the second generally opposite direction by secondary reflector 40 passes through a small secondary opening 44 in the wall 30 of the primary reflector 20 and through an aperture 46 in the housing 14.

The smaller secondary opening 44 is small enough in relation to the cavity 34 so that the amount of light reflected through the smaller secondary opening 44 does not substantially reduce the total amount of light reflected in the first direction. It can be seen that the tab comprises only a small percentage of the area of the wall from which it is punched.

The structure of light fixture 10 is quite simple and, therefore, easy to manufacture and assemble. These features also make the light fixture 10 quite economical. Because the secondary reflector 40 is within the cavity 34, it does not affect the appearance of the light fixture 10 adversely. In addition, the light directed in the second direction, different from the reflection direction of the majority of the light from light fixture 10, comes from a single illumination source, not an auxiliary bulb as in the prior art.

Although the present invention has been described with reference to preferred embodiments, workers skilled in the art will recognize that changes may be made in form and detail without departing from the spirit and scope of the invention.

What is claimed is:

1. A light fixture comprising:

a primary reflector having a wall, the wall having a reflector surface defining a cavity, the cavity having an opening facing generally in a first direction, the primary reflector being positioned for directing light beams from an illumination source in the first direction and having a second opening smaller than the cavity defined through the wall; and a secondary reflector positioned within the cavity at a location so as to direct light beams from the same illumination source in a second direction generally opposite from the first direction through the second smaller opening through the wall of the primary reflector.

2. The fixture of claim 1 and an illumination source positioned within the cavity of the primary reflector.

3. The fixture of claim 1 wherein the secondary reflector is mounted on the wall of the primary reflector adjacent the second smaller opening in the wall of the primary reflector.

4. The fixture of claim 1 wherein the secondary reflector comprises a tab formed from the wall of the primary reflector.

5. The fixture of claim 4 wherein the secondary reflector is a tab slit from the wall of the primary reflector and remaining attached to the wall along one edge of the tab, the second smaller opening in the wall being the area of the wall cut out to form the tab, the end of the tab being bent away from the wall so that a portion of the light beams from an illumination source within the cavity area of the primary reflector are directed by a reflector surface on the tab through the smaller opening in the wall of the primary reflector.

6. The fixture of claim 1 further comprising:

a housing having side walls and a bottom wall attached to the side walls, the side walls of the housing defining a generally open top, the primary reflector being mounted in the housing on the side walls so that light beams are directed by the primary reflector in the generally first direction through the open top of the housing, and the bottom wall of the housing having an aperture aligned with the second smaller opening in the wall of the primary reflector.

7. The fixture of claim 1 wherein a fresnel lens is positioned in the aperture of the bottom wall of the housing.

8. A light fixture comprising:

a single light source;

a primary reflector having a wall with one surface thereof being light-reflective and defining a cavity, the cavity having an opening facing generally in a first direction, the primary reflector being positioned for reflecting light beams from the light source in the first direction and having a second opening smaller than the cavity defined through the wall; and a secondary reflector having a light-reflective surface and being positioned within the cavity to reflect light beams from the light source in a second direction generally opposite from the first direction through the second smaller opening of the wall of the primary reflector.

* * * * *